US011215381B2

(12) United States Patent
Hasirumane et al.

(10) Patent No.: US 11,215,381 B2
(45) Date of Patent: Jan. 4, 2022

(54) VARIABLE POWER WATER HEATER

(71) Applicant: B/E Aerospace, Inc., Winston-Salem, NC (US)

(72) Inventors: Avinash Srikantegowda Hasirumane, Bothell, WA (US); Tyson J. Steenstra Toussaint, Marysville, WA (US); Bradley J. Buniak, Woodinville, WA (US)

(73) Assignee: B/E Aerospace, Inc., Winston-Salem, NC (US)

( * ) Notice: Subject to any disclaimer, the term of this patent is extended or adjusted under 35 U.S.C. 154(b) by 373 days.

(21) Appl. No.: 16/277,796

(22) Filed: Feb. 15, 2019

(65) Prior Publication Data

US 2020/0263904 A1 Aug. 20, 2020

(51) Int. Cl.
*F24H 9/20* (2006.01)
*F24H 1/20* (2006.01)

(52) U.S. Cl.
CPC ..... *F24H 9/2021* (2013.01); *F24H 1/201* (2013.01)

(58) Field of Classification Search
CPC ..... F24H 9/2021
See application file for complete search history.

(56) References Cited

U.S. PATENT DOCUMENTS 4,357,524 A 11/1982 Apfelbeck et al.
6,064,801 A 5/2000 Stokes et al.
6,841,761 B1 * 1/2005 Banzato ..... F24C 15/106 219/485
2006/0263073 A1 * 11/2006 Clarke ..... F24H 9/2071 392/347
2007/0272678 A1 * 11/2007 Meyuchas ..... G05D 23/24 219/494
2014/0033409 A1 * 2/2014 O'Malley ..... A61F 9/025 2/435
2015/0035509 A1 * 2/2015 Koyama ..... H02M 3/157 323/283
2017/0079090 A1 * 3/2017 De' Longhi et al. ..... H05B 1/0261
2018/0238563 A1 * 8/2018 Stepa ..... H02S 10/20

FOREIGN PATENT DOCUMENTS

EP 2375854 A1 10/2011
JP 2002295907 A 10/2002
JP 2017058040 A 3/2017

OTHER PUBLICATIONS

Extended Search Report for European Application No. 19215672.7 dated Jul. 15, 2020, 8 pages.

* cited by examiner

*Primary Examiner* — Nathaniel Herzfeld
(74) *Attorney, Agent, or Firm* — Suiter Swantz pc llo

(57) ABSTRACT

A variable power water heater is disclosed. In embodiments, the variable power water heater includes a water tank, a heating element, a power supply circuit, a switch, and a controller. The heating element may be disposed within or coupled to the water tank. The power supply circuit may be configured to generate a power signal for the heating element. The switch may be configured to couple the power supply circuit to the heating element, and the controller may be configured to toggle the switch according to a pulse width modulation (PWM) scheme to control a duty cycle of the power signal transmitted from the power supply circuit to the heating element.

7 Claims, 3 Drawing Sheets

VARIABLE POWER WATER HEATER

BACKGROUND

Water heaters are typically designed with fixed hardware for powering their heating elements. This hardware may have fixed power requirements. Consequently, an entire water heater, or at least the hardware for powering its heating element, may need to be changed when the water heater is implemented in a facility (e.g., an aircraft or other passenger vehicle, a building, etc.) that does not meet the power requirements of the water heater.

SUMMARY

A variable power water heater is disclosed. In embodiments, the variable power water heater includes a water tank, a heating element, a power supply circuit, a switch, and a controller. The heating element may be disposed within or coupled to the water tank. The power supply circuit may be configured to generate a power signal for the heating element. The switch may be configured to couple the power supply circuit to the heating element, and the controller may be configured to toggle the switch according to a pulse width modulation (PWM) scheme to control a duty cycle of the power signal transmitted from the power supply circuit to the heating element.

In some embodiments of the variable power water heater, the switch may include or may be a triac.

In some embodiments of the variable power water heater, the controller may be further configured to detect an identifier and determine the PWM scheme based on the identifier.

In some embodiments of the variable power water heater, the controller may be configured to detect the identifier via an interface connection between the controller and an aircraft communication system and/or an aircraft power system.

In some embodiments of the variable power water heater, the controller may be configured to determine the PWM scheme based on the identifier by comparing the identifier with a lookup table including a plurality of identifiers and a plurality of PWM schemes corresponding to the plurality of identifiers.

In some embodiments of the variable power water heater, the controller may be configured to set the PWM scheme to a default PWM scheme when the controller is unable to detect the identifier.

In some embodiments of the variable power water heater, the controller may be configured to detect one or more power source characteristics and determine the PWM scheme based on the one or more power source characteristics.

In some embodiments of the variable power water heater, the controller may be configured to detect the one or more power source characteristics via an interface connection between the controller and an aircraft communication system and/or an aircraft power system.

In some embodiments of the variable power water heater, the controller may be configured to determine the PWM scheme by calculating the duty cycle of the power signal based on the one or more power source characteristics.

In some embodiments of the variable power water heater, the power supply circuit and the controller may be integrated into a combined power supply and control circuit.

A control system for a variable power water heater is also disclosed. In embodiments, the control system includes a power supply circuit, a switch, and a controller. The power supply circuit may be configured to generate a power signal for a heating element of the variable power water heater. The switch may be configured to couple the power supply circuit to the heating element, and the controller may be configured to toggle the switch according to a PWM scheme to control a duty cycle of the power signal transmitted from the power supply circuit to the heating element.

In some embodiments of the control system, the switch may include or may be a triac.

In some embodiments of the control system, the controller may be further configured to detect an identifier and determine the PWM scheme based on the identifier.

In some embodiments of the control system, the controller may be configured to detect the identifier via an interface connection between the controller and an aircraft communication system and/or an aircraft power system.

In some embodiments of the control system, the controller may be configured to determine the PWM scheme based on the identifier by comparing the identifier with a lookup table including a plurality of identifiers and a plurality of PWM schemes corresponding to the plurality of identifiers.

In some embodiments of the control system, the controller may be configured to set the PWM scheme to a default PWM scheme when the controller is unable to detect the identifier.

In some embodiments of the control system, the controller may be configured to detect one or more power source characteristics and determine the PWM scheme based on the one or more power source characteristics.

In some embodiments of the control system, the controller may be configured to detect the one or more power source characteristics via an interface connection between the controller and an aircraft communication system and/or an aircraft power system.

In some embodiments of the control system, the controller may be configured to determine the PWM scheme by calculating the duty cycle of the power signal based on the one or more power source characteristics.

In some embodiments of the control system, the power supply circuit and the controller may be integrated into a combined power supply and control circuit.

A method of controlling a variable power water heater is also disclosed. In embodiments, the method includes: generating a power signal for a heating element; detecting an identifier or one or more power source characteristics; determining a PWM scheme based on the identifier or the one or more power source characteristics; and toggling a switch that delivers the power signal to the heating element according to the PWM scheme to control a duty cycle of the power signal.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are provided for example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1A:
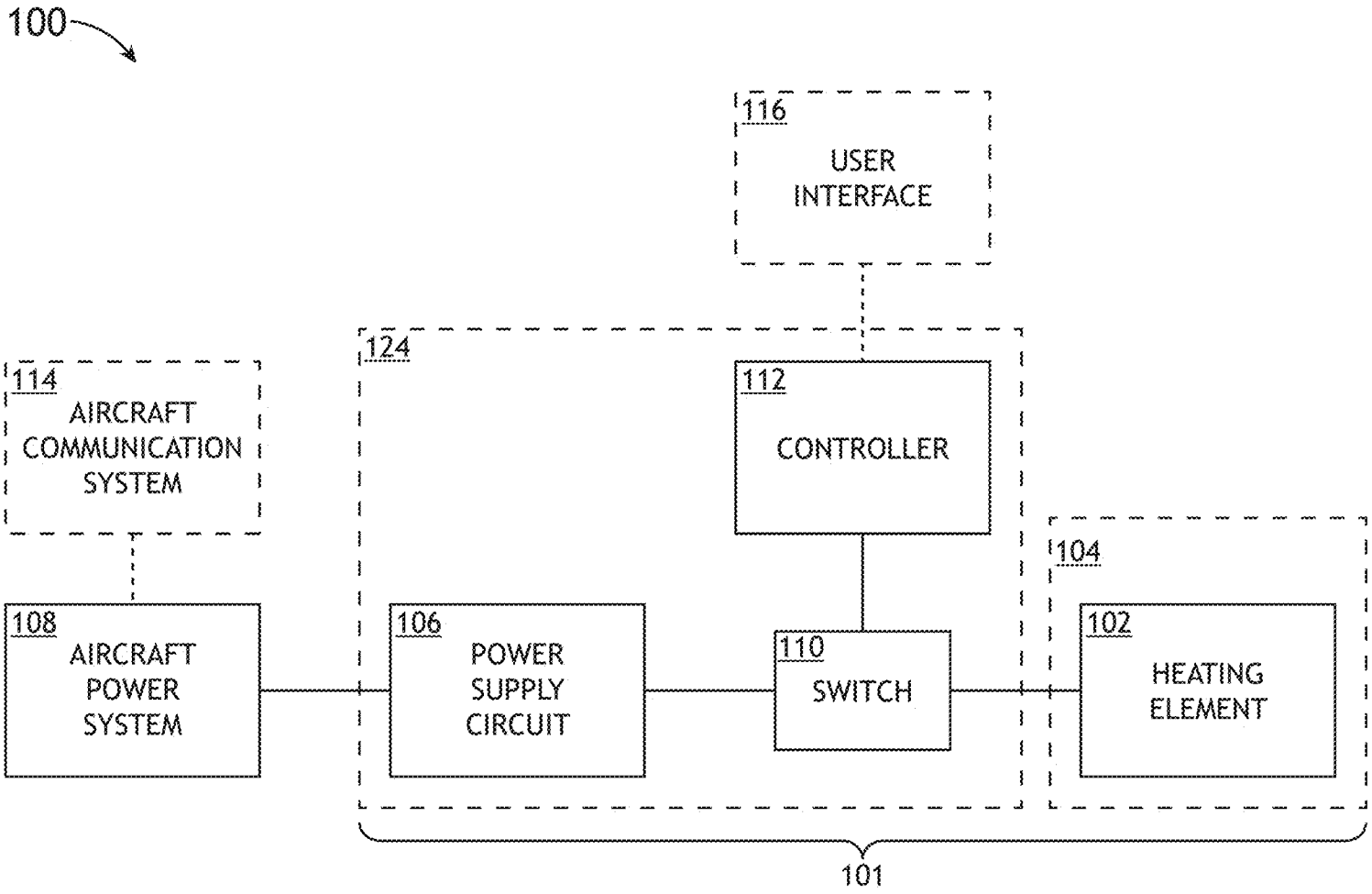
FIG. 1A is a block diagram illustrating an aircraft environment that includes a variable power water heater, in accordance with one or more embodiments of this disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination of sub-combination of two or more such features, along with any other features which may not necessarily be expressly described or inherently present in the instant disclosure.

A variable power water heater is disclosed. Often, water heaters are designed with fixed hardware for powering their heating elements. This hardware may have fixed power requirements. Consequently, an entire water heater, or at least the hardware for powering its heating element, may need to be changed when the water heater is implemented in a facility (e.g., an aircraft or other passenger vehicle, a building, etc.) that does not meet the power requirements of the water heater. The variable power water heater disclosed herein is a software-controlled water heater that can adjust its duty cycle to meet selected power requirements or power budget of an aircraft or any other setting/facility in which the variable power water heater is installed The variable power water heater may be configured for use in a variety of settings or facilities, such as, but not limited to, an aircraft lavatory (e.g., for a faucet, shower, etc.), an aircraft galley (e.g., for a coffee maker, faucet, dishwasher, etc.), or any other vehicle or building facility. Although an aircraft environment is discussed throughout this disclosure, the variable power water heater and/or control system for the variable power water heater may be implemented in any other setting or facility. In this regard, the examples and embodiments provided herein are not intended as limitations of the present disclosure unless otherwise specified in the claims.

FIG. 1A is a block diagram illustrating an aircraft environment/system 100 that includes a variable power water heater 101, in accordance with one or more embodiments of this disclosure. In some embodiments, the variable power water heater 101 includes a water tank 104, a heating element 102, a power supply circuit 106, a switch 110, and a controller 112. In other embodiments, one or more of the components (e.g., water tank 104, heating element 102, power supply circuit 106, switch 110, and/or controller 112) may be structurally separate from the variable power water heater 101. For example, the power supply circuit 106, switch 110, and/or controller 112 may be coupled to the variable power water heater 101 via an external connection interface (e.g., an external port or connector).

The heating element (or elements) 102 may be disposed within or coupled to the water tank 104. For example, in some embodiments, the heating element 102 may be disposed within the water tank 104 such that the heating element 102 becomes at least partially submerged when the water tank 104 is filled. In other embodiments, the heating element 102 (or another (e.g., second, third, etc.) heating element 102) may be coupled to a side or bottom portion of the water tank 104. For example, the heating element 102 may be coupled or otherwise held in contact with an internal or external side or bottom surface of the water tank 102. In other embodiments, the heating element 102 (or elements) may be configured to heat one or more tubes or pipes that flow the water. For example, the variable power water heater 101 may be a tankless water heater and/or configured with an auxiliary heating system. In some embodiments, the water tank 104 or heated tube/pipe may be continuously or periodically filled by portable water supplied from a main water tank of the aircraft.

The power supply circuit 106 may be configured to generate a power signal for the heating element 102. In embodiments, the power supply circuit 106 (e.g., a power supply unit (PSU), or the like) is coupled to a power source. For example, the power supply circuit 106 may be connected to an aircraft power system 108. In some embodiments, the aircraft power system 108 is configured to supply 115V, 400 Hz aircraft power. In other embodiments, the aircraft power system 108 may be configured to provide aircraft power at other voltages (e.g., at any voltage in the range of 100-240V, etc.) or other frequencies (e.g., at any frequency in the range of 100-1000 Hz, etc.).

The switch 110 may be configured to couple the power supply circuit 106 to the heating element 102. For example, the switch 110 can be configured to connect the power supply circuit 106 to the heating element 102 in a closed state and disconnect the power supply circuit 106 from the heating element 102 in an open state. In some embodiments, the switch 110 is part of the power supply circuit 106. In other embodiments, the switch 110 is a separate component disposed in between the power supply circuit 106 and the heating element 102. The switch 110 may be a triac (also known as a bidirectional triode thyristor or bilateral triode thyristor) or any other electrical or electromechanical switch element that connects the power supply circuit 106 to the heating element 102.

The controller 112 may be configured to toggle the switch 110 according to a pulse width modulation (PWM) scheme to control a duty cycle of the power signal transmitted from the power supply circuit 106 to the heating element 102. In this manner, water in the water tank 104 and/or heated tube/pipe can be heated by the heating element 102, and the power to the heating element 102 can be controlled by toggling the switch 110 according to the PWM-driven duty cycle to achieve target power requirements for the aircraft.

Figure 1B:
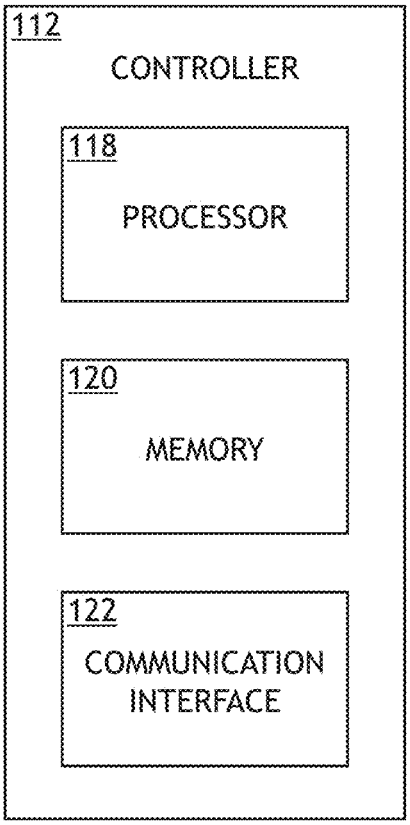
FIG. 1B is a block diagram illustrating a controller for the variable power water heater, in accordance with one or more embodiments of this disclosure.

As shown in FIG. 1B, the controller 112 may include a processor 118, memory 120, and a communication interface 122. The processor 118 provides processing functionality for at least the controller 112 and can include any number of processors, micro-controllers, circuitry, field programmable gate array (FPGA) or other processing systems, and resident or external memory for storing data, executable code, and other information accessed or generated by the controller 112. The processor 118 can execute one or more software programs embodied in a non-transitory computer readable medium (e.g., memory 120) that implement techniques described herein. The processor 118 is not limited by the materials from which it is formed, or the processing mechanisms employed therein and, as such, can be implemented via semiconductor(s) and/or transistors (e.g., using electronic integrated circuit (IC) components), and so forth.

The memory 120 can be an example of tangible, computer-readable storage medium that provides storage functionality to store various data and/or program code associated with operation of the controller 112/processor 118, such as software programs and/or code segments, or other data to instruct the processor 118, and possibly other components of the controller 112, to perform the functionality described herein. Thus, the memory 120 can store data, such as a program of instructions for operating the controller 112, including its components (e.g., processor 118, communication interface 122, etc.), and so forth. It should be noted that while a single memory 120 is described, a wide variety of types and combinations of memory (e.g., tangible, non-transitory memory) can be employed. The memory 120 can be integral with the processor 118, can comprise stand-alone memory, or can be a combination of both. Some examples of the memory 120 can include removable and non-removable memory components, such as random-access memory (RAM), read-only memory (ROM), flash memory (e.g., a secure digital (SD) memory card, a mini-SD memory card, and/or a micro-SD memory card), solid-state drive (SSD) memory, magnetic memory, optical memory, universal serial bus (USB) memory devices, hard disk memory, external memory, and so forth.

The communication interface 122 can be operatively configured to communicate with components of the controller 112. For example, the communication interface 122 can be configured to retrieve data from the processor 118 or other devices (e.g., aircraft power system 108, aircraft communication system 114, a temperature sensor (e.g., for sensing water temperature), user interface 116, etc.), transmit data for storage in the memory 120, retrieve data from storage in the memory 120, and so forth. The communication interface 122 can also be communicatively coupled with the processor 118 to facilitate data transfer between components of the controller 112 and the processor 118. It should be noted that while the communication interface 122 is described as a component of the controller 112, one or more components of the communication interface 122 can be implemented as external components communicatively coupled to the controller 112 via a wired and/or wireless connection. The controller 112 can also include and/or connect to one or more input/output (I/O) devices (e.g., user interface 116 or other human machine interface (HMI) devices) via the communication interface 122. In embodiments, the communication interface 122 may include a transmitter, receiver, transceiver, physical connection interface, or any combination thereof.

The power supply circuit 106 may include fixed hardware, and the power to the heating element 102 may be varied by toggling the switch 110 via the controller 112 to implement a selected PWM scheme. In other embodiments, the power supply circuit 106 and the controller 112 may be integrated into a combined power supply and control circuit 124. The power supply and control circuit 124 may be configured to output a PWM power signal with a controlled duty cycle. In either case, the controller 112 may be configured to execute software to determine an identifier (e.g., power system identifier, aircraft type, etc.) or one or more power source characteristics (e.g., supported wattage) and control the duty cycle of the power signal to power the heating element 102 according to the power source characteristics/requirements of the aircraft.

In some embodiments, the controller 112 is configured to detect an identifier and determine the PWM scheme based on the identifier. For example, the controller 112 may be configured to detect the identifier via an interface connection (e.g., identifier code sequence or programming detected via one or more connector pins) between the controller 112 and an aircraft communication system 114 (e.g., Controller Area Network (CAN) data bus, or the like) and/or the aircraft power system 108 itself. In another example, the controller 112 can be configured to receive the identifier in a data signal communicated via the aircraft communication system 114 or via user interface 116.

The controller 112 may be configured to determine the PWM scheme based on the identifier by comparing the identifier with a lookup table including a plurality of identifiers and a plurality of PWM schemes corresponding to the plurality of identifiers. For example, various aircraft types and/or power systems may be stored in a listing with corresponding PWM schemes or duty cycles for achieving the target power requirements for the aircraft.

In some embodiments, the controller 112 is configured to detect one or more power source characteristics and determine the PWM scheme based on the one or more power source characteristics. For example, the controller 112 may be configured to detect the one or more power source characteristics via an interface connection (e.g., code sequence or programming detected via one or more connector pins) between the controller 112 and an aircraft communication system 114 (e.g., Controller Area Network (CAN) data bus, or the like) and/or the aircraft power system 108 itself. In another example, the controller 112 can be configured to receive the one or more power source characteristics in a data signal communicated via the aircraft communication system 114 or via user interface 116.

The controller 112 may be configured to determine the PWM scheme by calculating the duty cycle of the power signal based on the one or more power source characteristics. For example, the controller 112 can be configured to calculate a duty cycle based on the one or more detected power source characteristics (e.g., based on supported wattage) for the aircraft. The controller 112 can be further configured to determine the PWM scheme for achieving the calculated duty cycle. Alternatively, the controller 112 may be configured to determine the PWM scheme based on the one or more power source characteristics by comparing the one or more power source characteristics with a lookup table including a plurality of power source characteristics and a plurality of PWM schemes corresponding to the different power source characteristics. For example, various power source characteristics (e.g., values or ranges of power requirements, supported wattages, etc.) may be stored in a listing with corresponding PWM schemes or duty cycles for achieving the target power requirements for the aircraft.

When the controller 112 is unable to detect an identifier and/or power source characteristics for the aircraft, or when there are no lookup table entries corresponding to the detected identifier and/or power source characteristics, the controller 112 may be configured to set the PWM scheme to a default PWM scheme. For example, in such cases, the controller 112 may be configured to set the PWM scheme to a PWM scheme associated with a default duty cycle (e.g., 70% duty cycle, 60% duty cycle, 50% duty cycle, or less).

In some embodiments, the controller 112 is communicatively coupled to a user interface 116. The controller 112 may be configured to receive a user-input temperature setting, duty cycle, identifier, power source characteristics, and/or power requirement via the user interface 116. In embodiments, the user interface 116 may include, but is not limited to, a display, a touchscreen display, touch panel, touchpad, keyboard, keypad, knob, buttons, switches, or any combination thereof. In some embodiments, the user interface 116 comprises a personal electronic device (e.g., mobile device, personal computer, etc.) that is communicatively coupled to the controller 112 via the aircraft communication system 114. In some embodiments, the user interface 116 can be used to override the controller programming, for example, to manually set the duty cycle or target power level/requirement.

Figure 2:
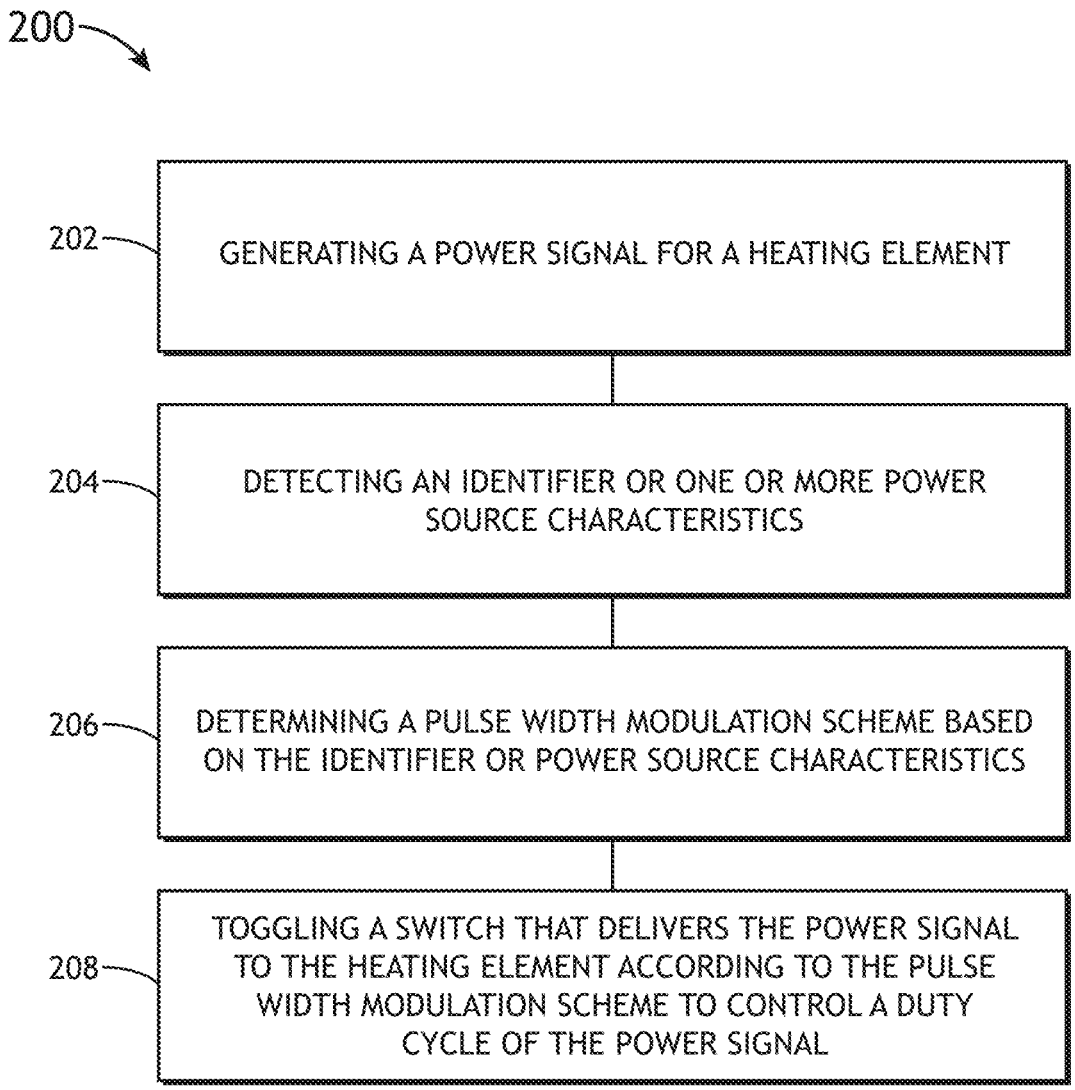
FIG. 2 is a flow diagram illustrating a method for controlling a variable power water heater, in accordance with one or more embodiments of this disclosure.

FIG. 2 illustrates one or more embodiments of a method 200 for controlling the variable power water heater 101 described herein. In general, any steps or operations of disclosed processes (e.g., method 200) may be performed in an arbitrary order, unless otherwise provided in the claims.

At step 202, the method 200 includes generating a power signal for a heating element 102. For example, the power supply circuit 106 may be configured to generate a power signal for the heating element 102.

At step 204, the method 200 includes detecting an identifier or one or more power source characteristics. For example, the controller 112 may be configured to detect the identifier or the one or more power source characteristics via an interface connection between the controller 112 and the aircraft communication system 114 and/or the aircraft power system 108. In another example, the controller 112 can be configured to receive the identifier or the one or more power source characteristics in a data signal communicated via the aircraft communication system 114 or via user interface 116.

At step 206, the method 200 includes determining a PWM scheme based on the identifier or the one or more power source characteristics. For example, the controller 112 may be configured to determine the PWM scheme based on the identifier by comparing the identifier with a lookup table including a plurality of identifiers and a plurality of PWM schemes corresponding to the plurality of identifiers. In another example, the controller 112 can be configured to calculate a duty cycle based on the one or more detected power source characteristics and further configured to determine the PWM scheme for achieving the calculated duty cycle. Alternatively, the controller 112 may be configured to determine the PWM scheme based on the one or more power source characteristics by comparing the one or more power source characteristics with a lookup table including a plurality of power source characteristics and a plurality of PWM schemes corresponding to the different power source characteristics.

At step 208, the method 200 includes toggling a switch that delivers the power signal to the heating element according to the PWM scheme to control a duty cycle of the power signal. For example, the controller 112 may be configured to toggle the switch 110 according to the selected, calculated, or otherwise determined PWM scheme to control a duty cycle of the power signal transmitted from the power supply circuit 106 to the heating element 102. In this manner, water in the water tank 104 and/or heated tube/pipe can be heated by the heating element 102, and the power to the heating element 102 can be controlled by toggling the switch 110 according to the PWM-driven duty cycle to achieve target power requirements for the aircraft.

The method 200 may further include any step or operation implied or required by one or more embodiments of the variable power water heater 101/system 100 described herein. The variable power water heater 101/system 100 can also include any additional component or functionality expressed or implied by one or more embodiments of the method 200.

It is to be understood that implementations of the methods disclosed herein may include one or more of the steps described herein. Further, such steps may be carried out in any desired order and two or more of the steps may be carried out simultaneously with one another. Two or more of the steps disclosed herein may be combined in a single step, and in some implementations, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

What is claimed is:

1. A variable power water heater, comprising:

a water tank;

a heating element disposed within or coupled to the water tank;

a power supply circuit configured to generate a power signal for the heating element;

a switch configured to couple the power supply circuit to the heating element; and a controller configured to:

detect an aircraft type identifier via an interface connection between the controller and an aircraft communication system of an aircraft, wherein the aircraft includes an aircraft power system having a power source configured to supply aircraft power at 115V and 400 Hz;

determine a pulse modulation scheme based on the aircraft type identifier by comparing the aircraft type identifier with a lookup table including a plurality of aircraft type identifiers and a plurality of pulse width modulation schemes corresponding to the plurality of aircraft type identifiers; and toggle the switch according to the pulse width modulation scheme to control a duty cycle of the power signal transmitted from the power supply circuit to the heating element.

2. The variable power water heater of claim 1, wherein the switch comprises a triac.

3. The variable power water heater of claim 1, wherein the controller is further configured to set the pulse width modulation scheme to a default pulse width modulation scheme when the controller is unable to detect the aircraft type identifier.

4. The variable power water heater of claim 1, wherein the controller is further configured to:

detect one or more power source characteristics of the power source; and determine the pulse width modulation scheme based on the one or more power source characteristics.

5. The variable power water heater of claim 4, wherein the controller is configured to detect the one or more power source characteristics via an interface connection between the controller and at least one of the aircraft communication system or the aircraft power system.

6. The variable power water heater of claim 4, wherein the controller is further configured to determine the pulse width modulation scheme by calculating the duty cycle of the power signal based on the one or more power source characteristics.

7. The variable power water heater of claim 1, wherein the power supply circuit and the controller are integrated into a combined power supply and control circuit.

* * * * *